US009685148B2

(12) United States Patent
Fishman

(10) Patent No.: US 9,685,148 B2
(45) Date of Patent: Jun. 20, 2017

(54) METHOD AND DEVICE FOR WIRELESS POWER SOURCE FOR AN INSTRUMENT

(71) Applicant: Fishman Transducers, Inc., Andover, MA (US)

(72) Inventor: Lawrence Fishman, Winchester, MA (US)

(73) Assignee: Fishman Transducers, Inc., Andover, MA (US)

( * ) Notice: Subject to any disclaimer, the term of this patent is extended or adjusted under 35 U.S.C. 154(b) by 0 days.

(21) Appl. No.: 14/985,802

(22) Filed: Dec. 31, 2015

(65) Prior Publication Data

US 2016/0197521 A1 Jul. 7, 2016

Related U.S. Application Data

(60) Provisional application No. 62/099,338, filed on Jan. 2, 2015.

(51) Int. Cl.

| | |
|---|---|
| ***G10H 1/32*** | (2006.01) |
| ***G10H 3/00*** | (2006.01) |
| ***G10H 3/18*** | (2006.01) |

(52) U.S. Cl.

CPC ..... *G10H 3/181* (2013.01); *G10H 1/32* (2013.01); *G10H 3/18* (2013.01); *G10H 2230/035* (2013.01)

(58) Field of Classification Search

CPC .... G10H 3/181; G10H 2230/035; G10H 1/32; G10H 3/18

USPC ..... 84/743

See application file for complete search history.

(56) References Cited

U.S. PATENT DOCUMENTS

| | | | | |
|---|---|---|---|---|
| 3,622,681 | A * | 11/1971 | Hopping | G10H 3/22 84/725 |
| 4,245,540 | A * | 1/1981 | Groupp | G10H 3/26 84/726 |
| 5,726,369 | A * | 3/1998 | Gilday | G10H 1/32 84/327 |
| 7,351,905 | B2 | 4/2008 | Ioffe | |
| 7,741,734 | B2 | 6/2010 | Joannopoulos et al. | |
| 7,825,543 | B2 | 11/2010 | Karalis et al. | |
| 8,022,576 | B2 | 9/2011 | Joannopoulos et al. | |
| 8,076,800 | B2 | 12/2011 | Joannopoulos et al. | |
| 8,076,801 | B2 | 12/2011 | Karalis et al. | |
| 8,084,889 | B2 | 12/2011 | Joannopoulos et al. | |
| 8,097,983 | B2 | 1/2012 | Karalis et al. | |
| 8,193,768 | B2 | 6/2012 | Hallett | |
| 8,362,651 | B2 | 1/2013 | Hamam et al. | |
| 8,395,282 | B2 | 3/2013 | Joannopoulos et al. | |
| 8,395,283 | B2 | 3/2013 | Joannopoulos et al. | |
| 8,400,018 | B2 | 3/2013 | Joannopoulos et al. | |
| 8,400,019 | B2 | 3/2013 | Joannopoulos et al. | |
| 8,400,020 | B2 | 3/2013 | Joannopoulos et al. | |
| 8,400,021 | B2 | 3/2013 | Joannopoulos et al. | |

(Continued)

*Primary Examiner* — Jeffrey Donels

(74) *Attorney, Agent, or Firm* — Pearl Cohen Zedek Latzer Baratz LLP

(57) ABSTRACT

A musical instrument requiring power has a wireless resonate power receiver to receive electric energy from electromagnetic waves transmitted by a wireless resonate power transmitter when the wireless resonate power receiver is within an area covered by the wireless resonate power transmitter. The electric energy can be stored in a rechargeable power supply, such that the musical instrument can be charged wirelessly.

29 Claims, 7 Drawing Sheets

(56) References Cited

U.S. PATENT DOCUMENTS

| | | | | |
|---|---|---|---|---|
| 8,400,023 | B2 | 3/2013 | Joannopoulos et al. | |
| 8,400,024 | B2 | 3/2013 | Joannopoulos et al. | |
| 8,760,007 | B2 | 6/2014 | Joannopoulos et al. | |
| 8,760,008 | B2 | 6/2014 | Joannopoulos et al. | |
| 8,766,485 | B2 | 7/2014 | Joannopoulos et al. | |
| 8,772,971 | B2 | 7/2014 | Joannopoulos et al. | |
| 8,772,972 | B2 | 7/2014 | Joannopoulos et al. | |
| 8,791,599 | B2 | 7/2014 | Joannopoulos et al. | |
| 8,829,849 | B2 * | 9/2014 | Kim | H02J 5/005 320/108 |
| 8,836,172 | B2 | 9/2014 | Hamam et al. | |
| 9,065,286 | B2 | 6/2015 | Joannopoulos et al. | |
| 9,384,722 | B2 * | 7/2016 | Fishman | G10H 1/32 |
| 2003/0196542 | A1 * | 10/2003 | Harrison, Jr. | G04B 25/00 84/737 |
| 2004/0145567 | A1 * | 7/2004 | Ho | G06F 3/0395 345/163 |
| 2006/0087282 | A1 * | 4/2006 | Baarman | H02J 7/025 320/108 |
| 2007/0182367 | A1 * | 8/2007 | Partovi | H01F 5/003 320/108 |
| 2009/0218985 | A1 * | 9/2009 | Hallett | G10H 1/32 320/108 |
| 2009/0295163 | A1 * | 12/2009 | Frayne | F03B 17/06 290/54 |
| 2012/0068549 | A1 | 3/2012 | Karalis et al. | |
| 2012/0228960 | A1 | 9/2012 | Karalis et al. | |
| 2013/0181541 | A1 | 7/2013 | Karalis et al. | |
| 2014/0354071 | A1 | 12/2014 | Hamam et al. | |
| 2015/0188321 | A1 | 7/2015 | Joannopoulos et al. | |
| 2015/0194818 | A1 | 7/2015 | Karalis et al. | |

* cited by examiner

METHOD AND DEVICE FOR WIRELESS POWER SOURCE FOR AN INSTRUMENT

CROSS-REFERENCE TO RELATED APPLICATIONS

This application claims the benefit of prior U.S. Provisional Application Ser. No. 62/099,338, filed Jan. 2, 2015, which is incorporated by reference herein in its entirety.

FIELD OF THE INVENTION

The invention relates to wireless power sources for musical instruments. In particular, the invention relates to providing wireless electrical energy to a rechargeable power supply of a musical instrument and/or directly to electrical components of a musical instrument.

BACKGROUND

A wide variety of musical instruments can require electrical energy. For example, some musical instruments are acoustic and retrofitted with components that require power (e.g., an aftermarket pickup/preamp that is installed onto an acoustic musical instrument). In another example, some musical instruments have electric components that are integrated with the musical instrument (e.g., pickup that is integrated into an electric guitar, bass guitar or acoustic instrument during manufacturing).

When retrofitting electrical components onto musical instruments, it can be desirable to refrain from modifying the body of the instrument. In the case of acoustic and/or antique musical instruments, modifying the body of the instrument (e.g., drilling holes in the body or removing parts of the instrument then putting them back on can ruin the value of the instrument. In the case of acoustic and electric instruments, modifying the body of the instrument can affect both the general esthetic and/or the unaltered sound of the instrument.

Some musical instruments are collector items, thus even if the sound of the instrument does not change by modifying the body, having the musical instrument in its unchanged form can be valuable. Such instruments can continue to increase in value over time as long as their original form is unmodified.

Some musical instruments that require power have the instrument tethered to an electrical cord that allows power to reach the instrument. Using an electrical cord for power can limit movement of the instruments, and thus limit movement of the musician while playing. For musicians playing on stage, having limited movement can inhibit their ability to perform.

One solution to the problem of tethering is to provide battery power to the instruments. In the case of non-rechargeable batteries, batteries that can practicably fit on a musical instrument are often depleted after a few performances causing undesirable expense and waste.

Another solution to the problem of tethering is to provide wireless rechargeable batteries. Having a wireless rechargeable battery to power an instrument can allow for the musician to switch instruments mid-performance and to recharge the depleted instrument without doing anything more than putting the instrument within the vicinity of the transmitter.

Although musical instruments having rechargeable batteries that can receive power wirelessly through inductive charging have been written about, they typically have a variety of problems, and to date, none have been commercially successful. One difficulty is that inductive wireless charging can require that the rechargeable battery be placed within a very close proximity (e.g., almost touching) to the wireless power transmitter. Placement has to be so close to the wireless transmitter that it typically requires having a charging port on the instrument that fits with a port of the wireless power transmitter.

To place a rechargeable battery within sufficiently close proximity to the wireless transmitter for inductive wireless charging typically requires modification of a musical instrument. For example, a charging port on the musical instrument, as shown in U.S. Pat. No. 8,193,768.

Thus, for inductive wireless charging, modification to the exterior and/or interior of the musical instrument can be required. In the case of musical instruments (e.g., a hollow bodied acoustic guitar) that are retrofit with electronic components, physical alterations such as holes can be required (e.g., piercing a side of a traditional wooden instrument). In the case of musical instruments that are manufactured with the inductively rechargeable battery, the standard shape of the musical instrument can require modification. Physical modification to an existing instrument or modification of the shape of a musical instrument can distort sound quality and/or devalue the instrument.

Therefore, it is desirable to provide a power source for powering electrical components of musical instruments and/or electrical musical instruments that does not require modification of the instrument to add the power source. It is also desirable to provide power to a musical instrument wirelessly that allows for a longer distance between a transmitter and receiver. It is also desirable to provide power to electrical components of or coupled to musical instruments without using a cord.

SUMMARY OF THE INVENTION

One advantage of the invention is that is allows for a musical instrument to receive power without a cord using a wireless rechargeable power supply that does not need to be in very close proximity to a wireless power transmitter. Another advantage of the invention is, for the case of an existing musical instrument (e.g., an acoustic guitar or an electric guitar that will be retrofit with the wireless power), a wireless power source is coupled to the existing musical instrument without physically modifying the existing musical instrument. Another advantage of the invention is, for all musical instruments (e.g., newly manufactured with the wireless power supply integrated or existing musical instrument having the wireless power supply retrofit), the standard shape of an exterior of the musical instrument is not modified, thus maintaining sound integrity and value.

Another advantage of the invention is that it provides a simple intuitive mechanism (e.g., put the musical instrument in its case, put the musical instrument on its stand) for charging a rechargeable power supply.

In one aspect, the invention includes a power receiver for providing power to one or more electrical components coupled to a musical instrument, the power receiver comprising a resonator coupled to the musical instrument to capture electrical energy received wirelessly from an oscillating electromagnetic field and a rechargeable power supply coupled to the resonator to store the received electrical energy and provide power to the one or more electrical components coupled to the musical instrument.

In some embodiments, the power receiver includes a power conditioning circuit positioned between the resonator and the rechargeable power supply to control a rate at which the electrical energy is passed to the rechargeable power supply.

In some embodiments, the musical instrument is a standard acoustic guitar, the resonator is removeably mounted to an interior surface of a chamber of the standard acoustic guitar without modifying the interior surface, and the power conditioning circuit and the rechargeable battery are mounted on a neck block of the standard acoustic guitar.

In some embodiments, a boost converter positioned between the rechargeable battery and the one or more electrical components to boost an output voltage of the rechargeable power supply. In some embodiments, the boosted output voltage is between 8.5 volts and 18 volts.

In some embodiments, the captured electrical energy bypasses the rechargeable power supply and is provided directly to the one or more electrical components. In some embodiments, the rechargeable power supply is a battery, capacitor, or any combination thereof. In some embodiments, the musical instrument is a standard acoustic guitar and the resonator and the rechargeable power supply are removeably mounted to an interior surface of a chamber of the standard acoustic guitar without modifying the interior surface.

In some embodiments, the musical instrument is an electric guitar and the resonator and the rechargeable power supply are positioned within an interior chamber of the electric guitar.

In some embodiments, the power receiver includes a double-sided foam adhesive coupled to the resonator, the rechargeable power supply or both. In some embodiments, the resonator and the rechargeable battery are positioned within a housing, wherein the housing further comprises a width, height and length that dependent upon a size of the musical instrument, wherein the musical instrument is a standard musical instrument.

In another aspect, the invention includes a wireless power system for providing power to electrical components coupled to a standard musical instrument. The wireless power system includes a first resonator to wirelessly transmit an oscillating electromagnetic field within an area surrounding the power transmitter. The wireless power system also includes a second resonator coupled to the musical instrument to capture electrical energy received wirelessly from the oscillating electromagnetic field and a rechargeable power supply coupled to the second resonator to store the received electrical energy and provide power to the one or more electrical components coupled to the musical instrument.

In some embodiments, the wireless power system includes a power conditioning circuit positioned between the second resonator and the rechargeable power supply to control a rate at which the electrical energy is passed to the rechargeable power supply. In some embodiments, the first resonator is coupled to a standard guitar stand, a standard guitar case, a charging mat, a portable pack, or any combination thereof.

In some embodiments, the wireless power system includes a sensor coupled to the first resonator to sense whether the second resonator is within the area. In some embodiments, the wireless power system includes a boost converter positioned between the rechargeable battery and the one or more electrical components to boost an output voltage of the rechargeable power supply.

In some embodiments, the boosted output voltage is between 8.5 volts and 18 volts. In some embodiments, the rechargeable power source is a battery, a capacitor, or any combination thereof. In some embodiments, the captured electrical energy bypasses the rechargeable power supply and is provided directly to the one or more electrical components.

In some embodiments, the musical instrument is a standard acoustic guitar, the second resonator is removeably mounted to an interior surface of a chamber of the standard acoustic guitar without modifying the interior surface, and the power conditioning circuit and the rechargeable battery are mounted on a neck block of the standard acoustic guitar.

In some embodiments, the musical instrument is a standard acoustic guitar and the second resonator and the rechargeable power supply are removeably mounted to an interior surface of a chamber of the standard acoustic guitar without modifying the interior surface.

In some embodiments, the musical instrument is an electric guitar and the second resonator and the rechargeable power supply are positioned within an interior chamber of the electric guitar.

In some embodiments, the wireless power system includes a double-sided foam adhesive coupled to the first resonator, the second resonator, the rechargeable power supply or both. In some embodiments, the first resonator is coupled to a case for the musical instrument. In some embodiments, the first resonator is powered by a battery.

In some embodiments, the first resonator is coupled to a first magnet and the second resonator is coupled to a second magnet, the first magnet is attracted to the second magnet when positioned within a close proximity of the second magnet.

In some embodiments, the first resonator, the second resonator or both are coupled to an indicator light that emits light when the first resonator is in electrical communication with the second resonator. In some embodiments, the rechargeable power supply is coupled to an indicator light that indicates whether the rechargeable power supply is fully charged, low charged, or being charged.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may be understood by reference to the following detailed description when read with the accompanying drawings in which:

Figure 1:
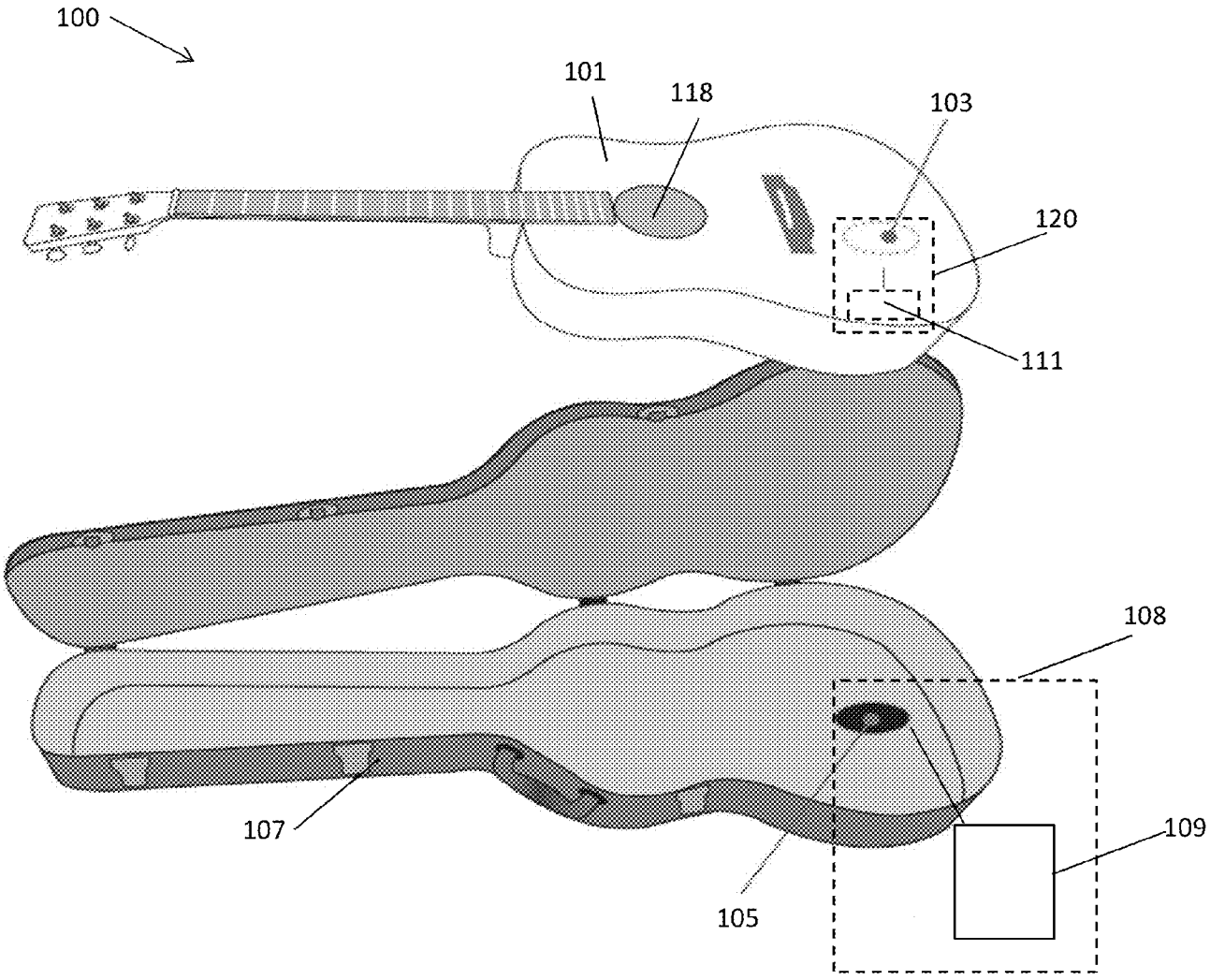
FIG. 1 is a diagram of a wireless power system for powering electrical components coupled to a musical instrument, according to an illustrative embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In general, a musical instrument and/or one or more electrical components coupled to a musical instrument require power to operate. For example, musical instruments such as guitar, bass, violin, and/or fiddle, are often equipped with devices that employ electronic circuits to amplify and/or modify audio signals produced by the musical instruments. These electronic circuits can rely on electrical energy to, for example, condition the audio signals for compatibility with sound reinforcement, broadcast the audio signals and/or record the audio signals.

A wireless power transmitter can transmit an oscillating electromagnetic field. A wireless power receiver coupled to a musical instrument can receive electric energy from the transmitted oscillating electromagnetic field and either store the electric energy or directly power the one or more electric components.

The wireless power transmitter includes a resonator that wirelessly transmits the oscillating electromagnetic field. The oscillating electromagnetic field spreads within an area surrounding the resonator. The wireless power receiver includes a resonator. When the resonator that is coupled to the musical instrument is placed within the area, the resonator of the musical instrument captures electric energy from the oscillating electromagnetic field. The resonator can provide the captured electric energy directly to the one or more electric components or to a rechargeable power supply. In the case of a rechargeable power supply, the rechargeable power supply can provide the stored energy to the musical instrument and/or the one or more electrical components.

FIG. 1 is a diagram of a wireless power system 100 for powering electrical components coupled to a musical instrument 101, according to an illustrative embodiment of the invention. The wireless power system includes the musical instrument 101 that is a guitar, a power receiver 120, a musical instrument case 107 that is a guitar case, and a power transmitter 108.

The power transmitter 108 includes a first resonator 105 and a power source 109. The first resonator 105 is capable of transmitting oscillating electromagnetic waves at a frequency within an area. The area can be based on the intensity of the electromagnetic waves. The power source 109 is in electrical communication with the first resonator 105 to provide power to the first resonator 105. As is shown in FIG. 1, the power source 109 can be external to the guitar case 107, for example, tethered to a conventional 110 or 220 volt A/C wall plug via a conventional cord. In some embodiments, the power source 109 is a rechargeable battery. In some embodiments, the power source 109 is a replaceable battery. In some embodiments, the power source 109 is a 110 or 220 volt A/C wall plug, USB cable, or car charger.

In some embodiments, the power source 109 is a very large battery. In some embodiments, the power source 109 is a rechargeable or replaceable battery that can be conveniently located in an accessory compartment common to many guitar cases. In some embodiments, the power source 109 can be a battery that is much larger than a battery that can fit in the musical instrument itself. In some embodiments, the power source 109 has a storage capacity five to ten times the capacity of the rechargeable power supply 111.

In this embodiment, the power source 109 is located remotely within the musical instrument case 107 from the first resonator 105 and is coupled to the first resonator 105 with wires that run within the musical instrument case structure to connect it to the first resonator 105. In some embodiments, the first resonator 105 is in a sleep mode that draws very little power when the musical instrument 101 not in the musical instrument case 107.

In some embodiments, when the musical instrument 101 is put into the case, a sensor (not shown) that is coupled to the first resonator 105 senses the presence of the second resonator 103 and turns on the first resonator 105. The transmitted power is picked up by the second resonator 103 that is contained within or attached to the wireless power receiver. The second resonator passes the received power to the power conditioner. In one embodiment the conditioned power is used to charge a rechargeable power storage device. In another embodiment the conditioned power is used to directly power the electrical components in the musical instrument.

The power transmitter 108 is coupled to the guitar case 107. The power transmitter 108 can be positioned on an interior surface of the guitar case 107. The power transmitter 108 can be positioned on an interior surface of the guitar case 107 in a location that puts it is sufficiently close proximity to the second resonator 103 when the musical instrument 101 is within the musical instrument case 107.

The power receiver 120 includes a second resonator 103 and rechargeable power supply 111. The second resonator 103 is capable of receiving electrical energy from oscillating electromagnetic waves and is in electrical communication (e.g., wired communication) with the rechargeable power supply 111. The rechargeable power supply 111 can receive electrical energy form the second resonator 103 and is electrically coupled to one or more electronic components (not shown) coupled to the musical instrument. The one or more electronic components can include a powered pickup, powered signal conditioner and/or a wireless audio transmitter.

The power receiver 120 is positioned on an interior surface of the guitar 101. The power receiver 120 can be positioned on the interior surface by inserting the power receiver through a sound hole 118 on the guitar 101 and removeably mounting the power receiver 120 to the interior surface. The power receiver 120 can be removeably mounted via a double-sided foam adhesive, Velcro, and/or any adhesive known in the art that allows for removable attachment to a surface.

As can be seen in FIG. 1, the mounting of the power receiver 120 on the guitar 101 does not require that the guitar 101 be modified. For example, the surfaces of the guitar 101 are not punctured, removed or otherwise modified, such that the shape and sound integrity of the guitar 101 can be maintained.

The guitar 101 can be an acoustic guitar. The guitar 101 can be a standard acoustic guitar as is known in the art.

In various embodiments, the musical instrument 101 can be a Fender STRATOCASTER electric guitar or Gibson LES PAUL electric guitar, or electric guitars modeled on and having similar or the same dimensions as these guitars, especially as concerns the cavities within these guitars. For example, a guitar in one embodiment may have the design of a standard cavity of a Fender STRATOCASTER electric guitar or Gibson LES PAUL electric guitar. Other or different electric guitars can be used. Components such as a power receiver, battery, voltage booster, or other components may be designed so that they fit within standard cavities in such instruments without protruding therefrom. For example, a power receiver, battery, and other components may according to some embodiments of the present invention be shaped and have dimensions so that they fit within the standard control cavity or spring cavity of the Fender STRATOCASTER electric guitar without protruding therefrom, and a standard cavity cover may cover the cavity, having the same shape, size, and screw hole configuration of the cover manufactured with the guitar. The standard cavities may be cavities created at the time of the manufacture of the guitar.

In some embodiments, the musical instrument 101 is a banjo, mandolin ukulele, violin, viola, cello or a double bass. It is apparent to one of ordinary skill in the art that a variety of acoustic instruments exists, and that in various embodiments, the musical instrument 101 is any existing acoustic instrument.

During operation, the power transmitter 108 transmits oscillating electromagnetic waves from the guitar case 107. When the guitar 101, and thus the power receiver 120 are positioned within the area (e.g., near or within the guitar case), the first resonator 105 of the power receiver 120 captures the electric energy generated by the oscillating electromagnetic waves. The electric energy is stored by the rechargeable power supply 111. In this manner, electric energy is transferred wirelessly from the guitar case 107 to the guitar 101.

Figures 1A, 1B:
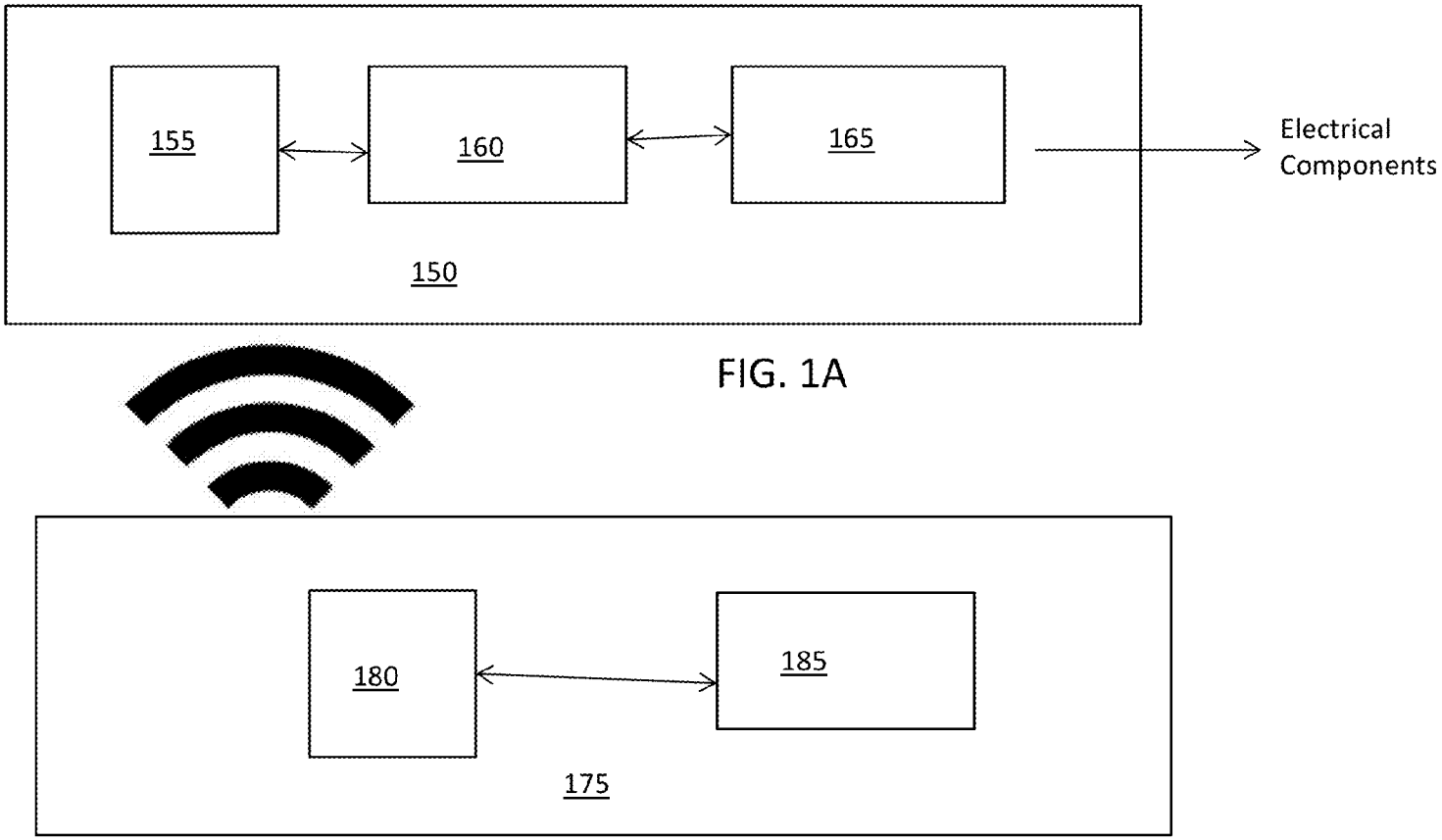
FIG. 1A is a diagram of a wireless power receiver for coupling to a musical instrument, according to an illustrative embodiments of the invention.
FIG. 1B is a block diagram of a wireless power transmitter for providing power to a musical instrument, according to an illustrative embodiment of the invention.

FIG. 1A is a block diagram of a power receiver 150, according to an illustrative embodiment of the invention. FIG. 1B is a block diagram of a power transmitter 175, according to an illustrative embodiment of the invention. The power receiver 150 can be coupled to a musical instrument (e.g., musical instrument 101 as described above in FIG. 1). The power transmitter 175 can be coupled to a musical instrument case (guitar case, flute case, etc.), a musical instrument stand (e.g., guitar stand, bass stand, etc.), a charging mat or a portable pack. In various embodiments, the power transmitter 175 is coupled to any object that is sufficient to place near a corresponding musical instrument.

In some embodiments, the power transmitter 175 can power multiple instruments that are within the transmitting area of the power transmitter 175. In this manner, multiple instruments can be charged simultaneously. For example, multiple musicians giving a performance can all charge their instruments at the same time during an intermission.

The power transmitter 175 includes a first resonator 180 and a power source 185. The first resonator 180 includes a coil (not shown) and can be capacitively loaded. The first resonator 180 is in electrical communication with the power source 185.

The power receiver 150 includes a second resonator 155, a power conditioning circuit 160 and a rechargeable power supply 165. The second resonator 155 includes a coil (not shown) and can be capacitively loaded. The second resonator 155 is capable of receiving electrical energy from oscillating electromagnetic waves and is in electrical communication with the power conditioning circuit 160. The power conditioning circuit 160 is in electrical communication with the rechargeable power supply 165. The rechargeable power supply 165 is in electrical communication with one or more electrical components coupled to a musical instrument (not shown).

During operation, the power source 185 provides power to the first resonator 180. The first resonator 180 emits electromagnetic energy.

The second resonator 155 and the first resonator 180 are configured such that they both resonate at a substantially common frequency. The resonant frequency of the second resonator 155 and the first resonator 180 can be a function of inductance L (which depends on the number of turns of each coil) multiplied by the capacitance C, e.g., 1/(LC)^0.5. In some embodiments, the second resonator 155 and the first resonator 180 are configured such that they each have a frequency that is different than the other. In these embodiments, the difference between the frequencies is small enough such that resonant energy transfer can still occur, but allow for a desired variation in power transfer from the second resonator 155 and the first resonator 180.

With a substantially common resonant frequency, the second resonator 155 and the first resonator 180 can form a tuned (LC) circuit when the second resonator 155 is within a sufficient proximity to an emitting (e.g., emitting electromagnetic energy) first resonator 180. The proximity (e.g., distance) between the second resonator 155 and the first resonator 180 can be based on the number of coils, the electromagnetic energy emitted from the second resonator 155 and/or the power required by the power receiver 150. The proximity between the first resonator 180 and the second resonator 155 can be 4-5 inches. In some embodiments, the proximity between the first resonator 180 and the second resonator 155 reaches up to 2.5 feet. The proximity between the second resonator 155 and the first resonator 180 can be determined as shown in, for example U.S. Pat. No. 7,741,734, incorporated herein by reference in its entirety.

The first resonator 180 transfers the electric energy received when completing a tuned LC circuit with the second resonator 155 to the power conditioning circuit 160. The power conditioning circuit 160 can smooth out the electric energy and/or provide the electric energy to the rechargeable power supply 165 at a desired rate. The desired charge rate is different for different battery chemistries and different battery charge capacities. The power conditioning circuit 160 often regulates the charge rate to optimize the charge time with respect to the rechargeable power supply 165 capacity, the safe operating temperature of the rechargeable power supply and/or the ambient temperature.

In some embodiments, the rechargeable power supply 165 is a rechargeable battery. In various embodiments, the rechargeable battery is lithium ion, nickel-cadmium, nickel metal hydride batteries, or other suitable batteries or rechargeable devices. In some embodiments, the rechargeable power supply 165 is a super capacitor. In various embodiments, the rechargeable power supply 165 is any energy storage or rechargeable device.

In some embodiments, the rechargeable power supply 165 is coupled to a voltage booster. The voltage booster can have an output voltage that depends on a type of musical instrument and/or the one or more components coupled to the musical instrument. For example, for a musical instrument of a guitar, typical guitar components can require 9 volt output. For a musical instrument of a violin, typical violin components can require 18 volt output. In this manner, the power receiver 150 can retrofit onto existing musical instruments, accounting for different power requirements of existing musical instrument.

In some embodiments, the resonator 155, the power conditioning circuit 160 and the rechargeable power supply 165 are positioned within housing. In these embodiments, the housing can have a width, height and length that depend on the particular musical instrument type. For example, the size of the housing for coupling to a flute can be smaller than the size of the housing for coupling to a drum set. In some embodiments, the size of the housing can depend on maintaining the musical sound of the instrument. In some embodiments, the musical instrument is a guitar and the power conditioning circuit 160 and the rechargeable power supply 165 are positioned on the neck block of the guitar, while the resonator 155 is positioned on another surface within the internal cavity within the guitar.

In some embodiments, one or more sensors are coupled to the power transmitter 175 to determine whether the power receiver 150 is too far a distance from the power transmitter 175 for efficient power transfer. In these embodiments, the power transmitter 175 enters a sleep mode (and/or turns off) when the power receiver 150 is not within a sufficient proximity to the power transmitter 175 to, for example, save power.

Figure 2A:
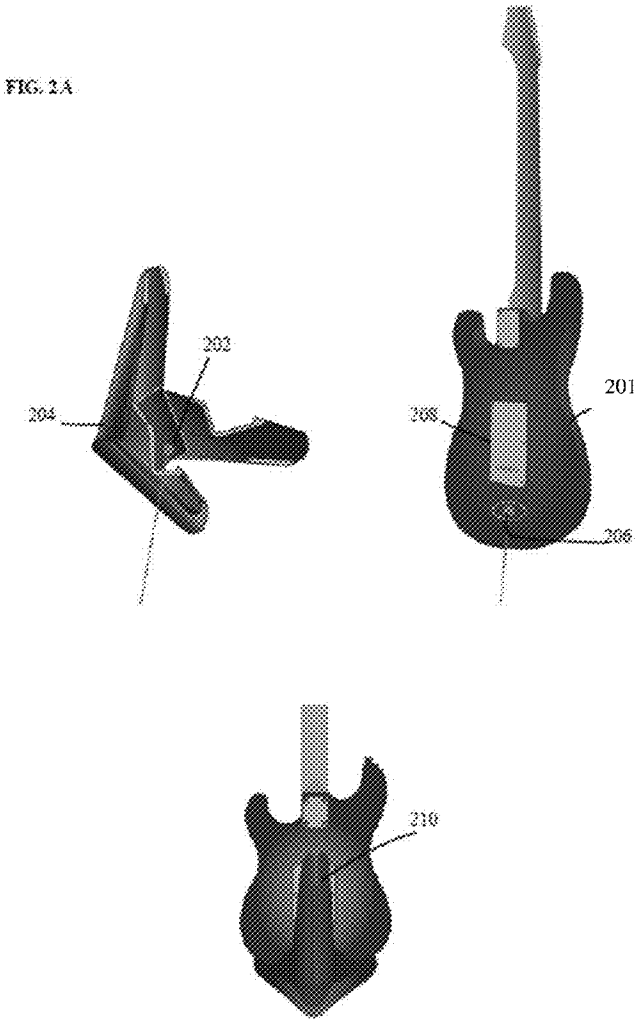
FIG. 2A is a diagram of a musical instrument having a wireless power receiver and a musical instrument stand having a wireless power transmitter, according to an illustrative embodiment of the invention.

FIG. 2A is a diagram of a musical instrument 201 having a wireless power receiver 20 and a musical instrument stand 210 having wireless power transmitter 202, according to an illustrative embodiment of the invention. The musical instrument 201 is an electric guitar. The electric guitar 201 includes a back plate 208 that when opened allows for placement of the wireless power receiver 206 within the electric guitar 201. In this manner the electric guitar 201 can be retrofit with the wireless power receiver 206. In some embodiments, the electric guitar 201 is manufactured with an internal cavity position for the wireless power receiver. The musical instrument stand 210 is an electric guitar stand.

During operation, when the wireless power transmitter 202 is transmitting oscillating electromagnetic energy and the electric guitar 201 is placed within the electric guitar stand 210, the wireless power receiver 206 receives electric energy from the wireless power transmitter 202. In this manner, the electric guitar 201 can receive power wirelessly from the electric guitar stand 210.

Figure 2B:
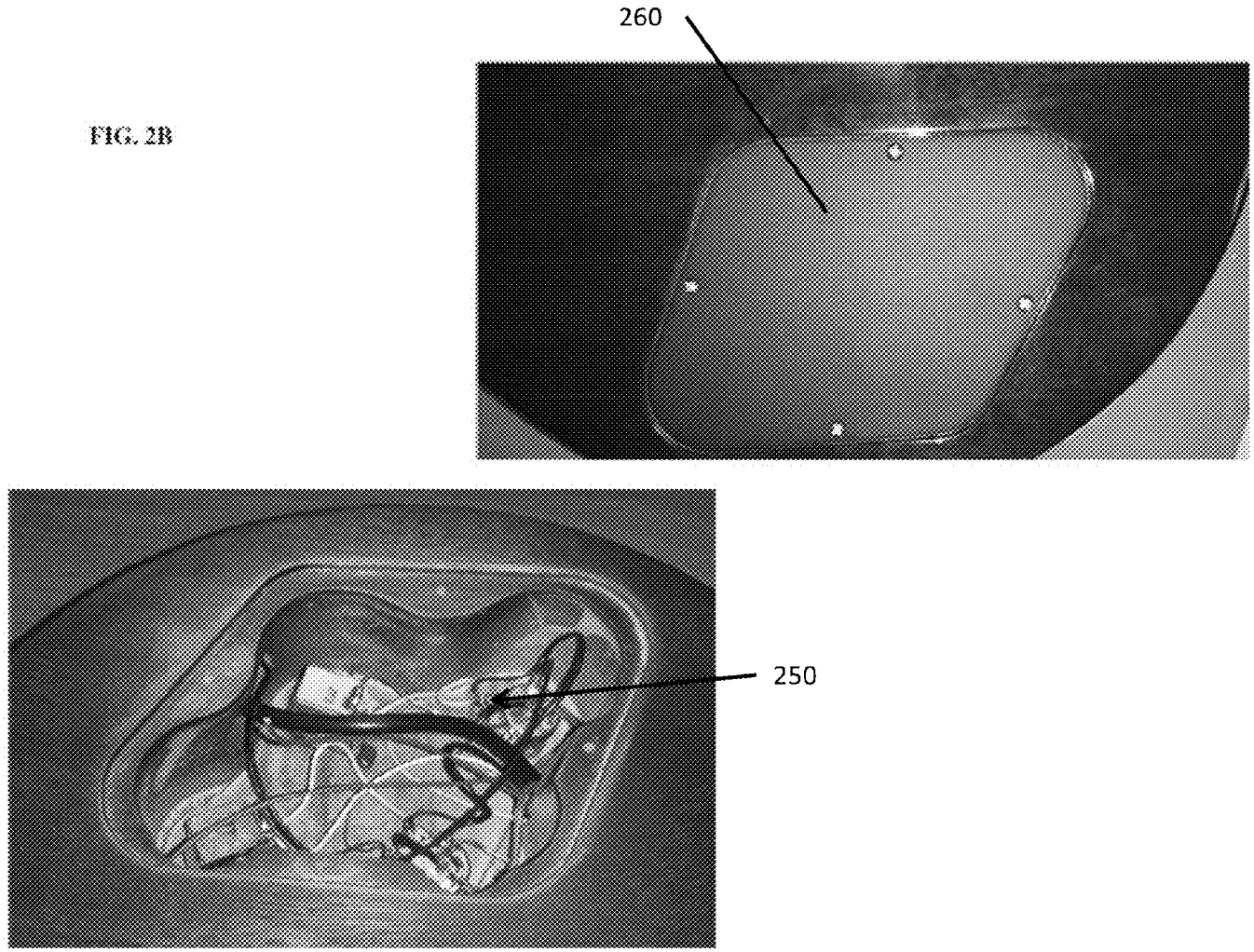
FIG. 2B is a diagram of a pre-existing cavity on an electric guitar with a standard cover with a wireless power receiver disposed therein, according to an illustrative embodiment of the invention.

FIG. 2B illustrates a pre-existing cavity 250 on a standard electric guitar with a standard cover 260, according to an illustrative embodiment of the invention. As is typical for standard electric guitars, the standard cover 260 can be removed and reaffixed such that some of the electronics of the guitar can be reattached and/or replaced. When the standard cover 260 is removed from the guitar, the pre-existing cavity 250 is opened. With the standard cover 260 removed, a wireless power receiver (e.g., power receiver 108, as described above in FIG. 1) can be positioned within the pre-existing cavity 250, and thus positioned within the guitar. The standard cover 260 can then be reaffixed to the guitar, with the wireless power receiver positioned within the cavity. In this manner, the wireless power receiver is coupled to the electric guitar without modifying the electric guitar. The electric guitar can receive wireless power without compromising the musical integrity or the value of the electric guitar.

Figure 3:
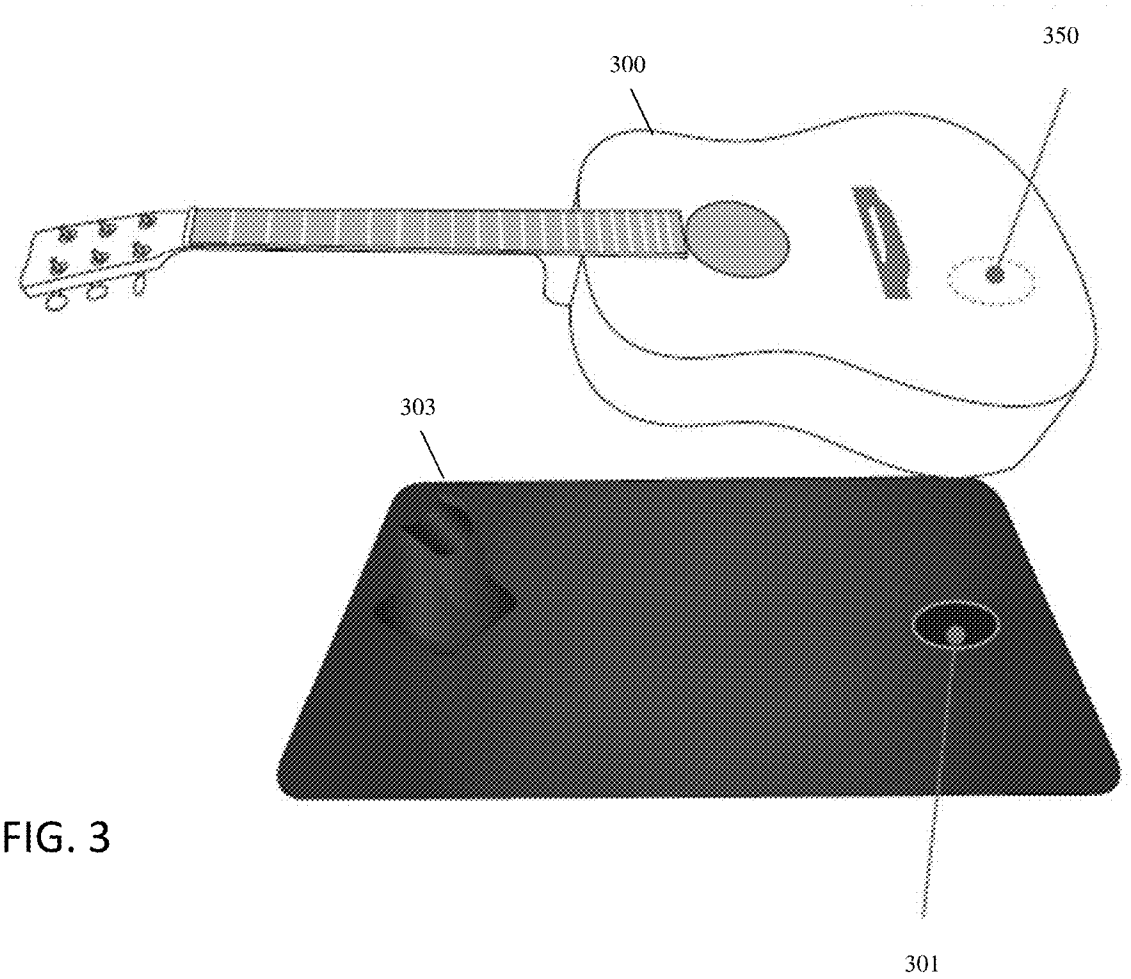
FIG. 3 is a diagram of musical instrument having a wireless power receiver and a work pad having a wireless power transmitter, according to an illustrative embodiment of the invention.

FIG. 3 is a diagram of musical instrument 300 having a wireless power receiver 302 and a work pad 303 having a wireless power transmitter 301, according to an illustrative embodiment of the invention. The musical instrument 300 is an acoustic guitar. The acoustic guitar 300 is coupled to the wireless power receiver 301. The work pad 303 is coupled to the wireless power transmitter 301. During operation, when the acoustic guitar 300 is positioned on the work pad 303 and the wireless power transmitter is emitting, the wireless power receiver 301 receives electric power.

Figure 4:
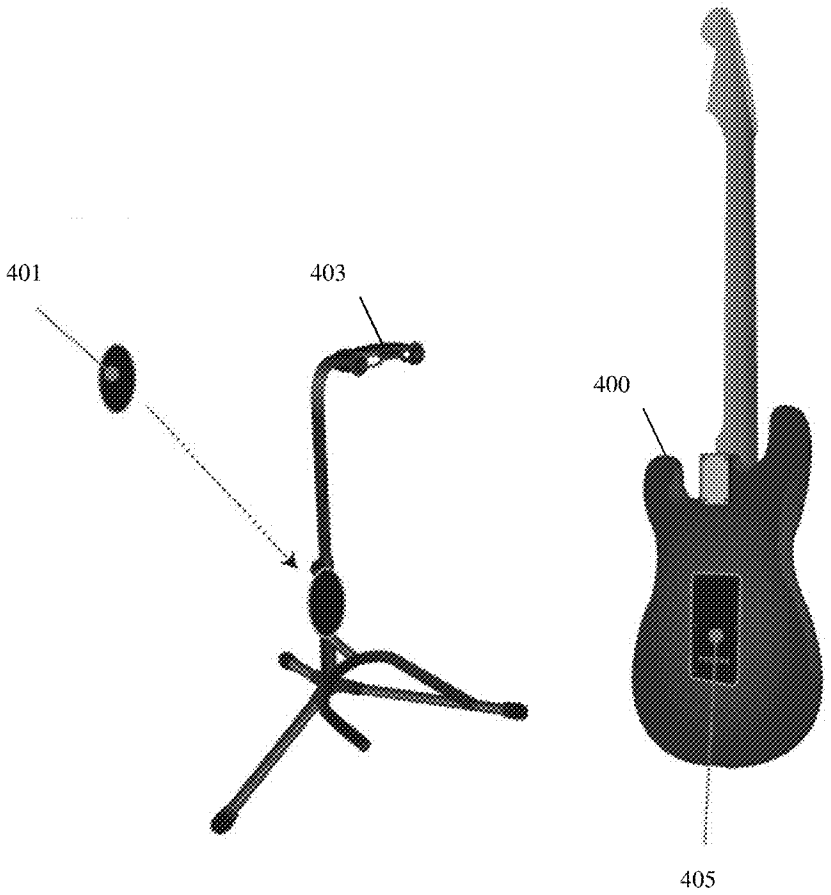
FIG. 4 is a diagram of musical instrument having a wireless power receiver and a musical instrument stand with a detachable wireless power transmitter, according to an illustrative embodiment of the invention.

FIG. 4 is a diagram of musical instrument 400 having a wireless power receiver 405 and a musical instrument stand 403 having a wireless power transmitter 401, according to an illustrative embodiment of the invention. The musical instrument 400 is an electric guitar and the musical instrument stand 403 is a guitar stand.

The electric guitar 400 has the wireless power receiver 401 removeably attached to the back of the electric guitar 400. The guitar stand 403 has the wireless power transmitter 401 removeably attached to the guitar stand 403. The wireless power transmitter 401 can include a clip on mechanism such that the wireless power transmitter 401 can be clipped onto the guitar stand 403.

During operation, when the electric guitar 400 is positioned in the guitar stand 401 and the wireless power transmitter 401 is emitting, the wireless power receiver 405 receives electric power.

Wireless power transmitters may not necessarily be integrated within a device or object. The wireless power transmitter may be a standalone device that can be moved or repositioned onto different objects. The wireless power receiver can be a stand-alone device. In some embodiments, a stand-alone power receiver and a stand-alone power transmitter can a convenient option because, for example, users can adjust the wireless charging system to operate with instruments stands and/or other equipment that they already own.

Batteries in an instrument may be internal to the instrument (e.g., in the case of an acoustic guitar, the battery may not always reside within a standard cavity), the musician may need assistance in determining the location of the battery to pair it with a power transmitter.

Figure 5:
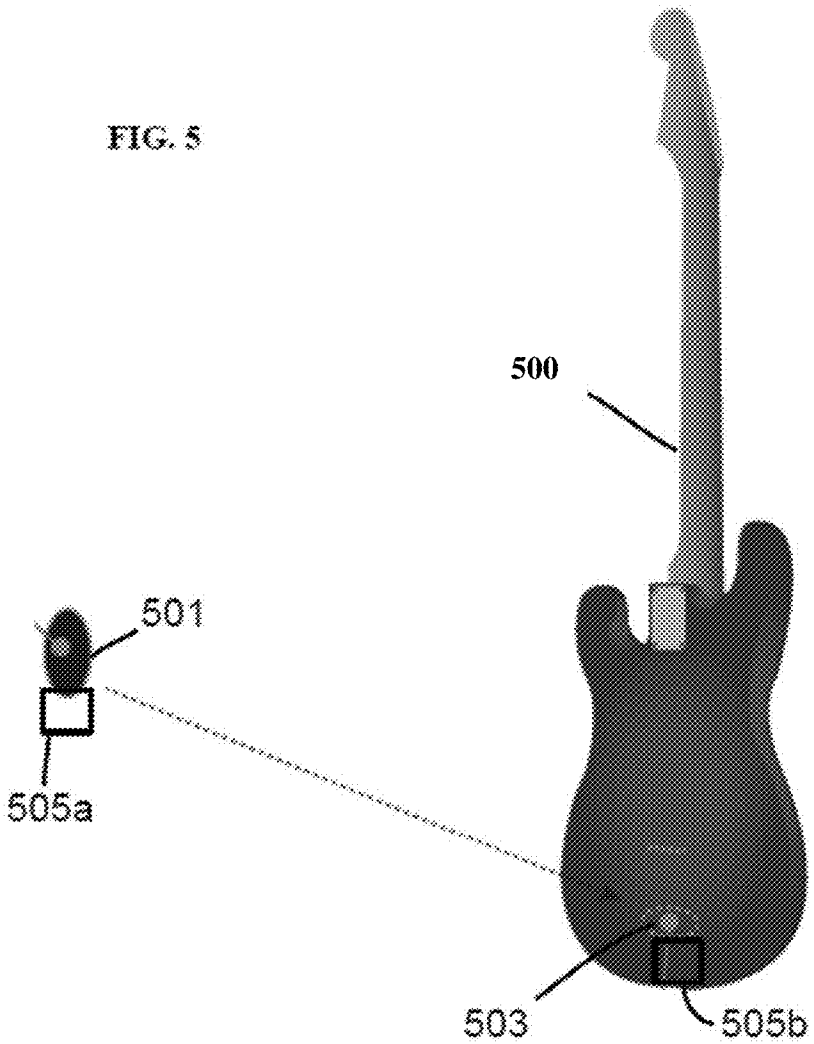
FIG. 5 is a diagram of musical instrument having a wireless power receiver and a stand-alone wireless power transmitter, according to an illustrative embodiment of the invention.

FIG. 5 is a diagram of musical instrument 500 having integrated wireless receiver 503 and a stand-alone wireless power transmitter 501, according to an illustrative embodiment of the invention.

The stand-alone wireless power transmitter 501 includes a first magnet 505*a*, and the wireless power receiver 503 includes a second magnet 505*b*. In operation, when the first magnet 505*a* is positioned near the second magnet 505*b*, the second magnet 505*b* attracts the first magnet 505*a* such that a user knows the location of the wireless power receiver 503 integrated within the musical instrument 500.

In some embodiments, the first magnet 505*a* and the second magnet 505*b* are sufficiently strong as to help locate the position of the power receiver 503. In some embodiments, the first magnet 505*a* and the second magnet 505*b* are sufficiently strong as to hold the power transmitter 501 in the proper position during charging. In other embodiments, the power transmitter 501 can be temporarily held in the correct charging position by suction cups, a removable tape and/or putty.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices.

In some embodiments, a wireless power transmitter (e.g., first resonator 105 as shown above in FIG. 1) is coupled to an indicator that indicates when the wireless power transmitter is coupled to a wireless power receiver (e.g., first resonator 105 as shown above in FIG. 1).

In some embodiments, a wireless power receiver (e.g., first resonator 105 as shown above in FIG. 1) is coupled to an indicator that indicates whether a rechargeable power supply coupled to the wireless power transmitter is fully charged, partially charged and/or coupled to a wireless power transmitter.

The indicator can be a LED light, a sound indicator or other type of indicator as is known in the art.

The embodiments described in these appendices are non-limiting, and features of some specifically described embodiments may be used with other embodiments. It will be appreciated by persons skilled in the art that embodiments of the invention are not limited by what has been particularly shown and described hereinabove. Rather the scope of at least one embodiment of the invention is defined by the claims below.

The invention claimed is:

1. A power receiver for providing power to one or more electrical components coupled to a musical instrument, the power receiver comprising:

a resonator coupled to the musical instrument to capture magnetic energy received wirelessly from an oscillating magnetic field; and a rechargeable power supply coupled to the resonator to store electrical energy generated from the received magnetic energy and provide power to the one or more electrical components coupled to the musical instrument.

2. The power receiver of claim 1 further comprising:

a power conditioning circuit positioned between the resonator and the rechargeable power supply to control a rate at which the electrical energy is passed to the rechargeable power supply.

3. The power receiver of claim 2 wherein the musical instrument is a standard acoustic guitar, the resonator is removeably mounted to an interior surface of a chamber of the standard acoustic guitar without modifying the interior surface, and the power conditioning circuit and the rechargeable power supply are mounted on a neck block of the standard acoustic guitar.

4. The power receiver of claim 1 further comprising:

a boost converter positioned between the rechargeable power supply and the one or more electrical components to boost an output voltage of the rechargeable power supply.

5. The power receiver of claim 3 wherein the boosted output voltage is between 8.5 volts and 18 volts.

6. The power receiver of claim 1 wherein captured electrical energy bypasses the rechargeable power supply and is provided directly to the one or more electrical components.

7. The power receiver of claim 1 wherein the rechargeable power supply is a battery, capacitor, or both.

8. The power receiver of claim 1 wherein the musical instrument is a standard acoustic guitar and the resonator and the rechargeable power supply are removeably mounted to an interior surface of a chamber of the standard acoustic guitar without modifying the interior surface.

9. The power receiver of claim 1 wherein the musical instrument is an electric guitar and the resonator and the rechargeable power supply are positioned within an interior chamber of the electric guitar.

10. The power receiver of claim 1 further comprising a double-sided foam adhesive coupled to the resonator, the rechargeable power supply or both.

11. The power receiver of claim 1 wherein the resonator and the rechargeable battery are positioned within a housing, wherein the housing further comprises a width, height and length that is dependent upon a size of the musical instrument, wherein the musical instrument is a standard musical instrument.

12. A wireless power system for providing power to electrical components coupled to a standard musical instrument, comprising:

a first resonator to wirelessly transmit an oscillating magnetic field within an area surrounding the power transmitter;

a second resonator coupled to the musical instrument to capture magnetic energy received wirelessly from the oscillating magnetic field and generate electrical energy from the captured magnetic energy; and a rechargeable power supply coupled to the second resonator to store the received electrical energy and provide power to the one or more electrical components coupled to the musical instrument.

13. The wireless power system of claim 12 further comprising:

a power conditioning circuit positioned between the second resonator and the rechargeable power supply to control a rate at which the electrical energy is passed to the rechargeable power supply.

14. The wireless power system of claim 12 wherein the first resonator is coupled to a standard guitar stand, a standard guitar case, a charging mat, or a portable pack.

15. The wireless power system of claim 13 further comprising a sensor coupled to the first resonator to sense whether the second resonator is within the area.

16. The wireless power system of claim 12 further comprising:

a boost converter positioned between the rechargeable battery and the one or more electrical components to boost an output voltage of the rechargeable power supply.

17. The wireless power system of claim 16 wherein the boosted output voltage is between 8.5 volts and 18 volts.

18. The wireless power system of claim 12 wherein the rechargeable power source is a battery, a capacitor, or both.

19. The wireless power system of claim 12 wherein the captured electrical energy bypasses the rechargeable power supply and is provided directly to the one or more electrical components.

20. The wireless power system of claim 12 wherein the musical instrument is a standard acoustic guitar, the second resonator is removeably mounted to an interior surface of a chamber of the standard acoustic guitar without modifying the interior surface, and the power conditioning circuit and the rechargeable battery are mounted on a neck block of the standard acoustic guitar.

21. The wireless power system of claim 12 wherein the musical instrument is a standard acoustic guitar and the second resonator and the rechargeable power supply are removeably mounted to an interior surface of a chamber of the standard acoustic guitar without modifying the interior surface.

22. The wireless power system of claim 12 wherein the musical instrument is an electric guitar and the second resonator and the rechargeable power supply are positioned within an interior chamber of the electric guitar.

23. The wireless power system of claim 12 further comprising a double-sided foam adhesive coupled to the first resonator, the second resonator, the rechargeable power supply or both.

24. The wireless power system of claim 12 wherein the first resonator is coupled to a case for the musical instrument.

25. The wireless power system of claim 12 wherein the first resonator is powered by a battery.

26. The wireless power system of claim 12 wherein the first resonator is coupled to a first magnet and the second resonator is coupled to a second magnet, the first magnet is attracted to the second magnet when positioned within a proximity of the second magnet.

27. The wireless power system of claim 12 wherein the first resonator is coupled to an indicator light that emits light when the first resonator is in magnetic communication with the second resonator.

28. The wireless power system of claim 12 wherein the rechargeable power supply is coupled to an indicator light that indicates whether the rechargeable power supply is fully charged, low charged, or being charged.

29. A power receiver for providing power to one or more electrical components coupled to a musical instrument, the power receiver comprising:

a resonator coupled to the musical instrument to capture magnetic energy received wirelessly from an oscillating magnetic field and provide power to the one or more electrical components coupled to the musical instrument.

* * * * *